US007546926B2

(12) United States Patent
Stolle et al.

(10) Patent No.: US 7,546,926 B2
(45) Date of Patent: Jun. 16, 2009

(54) CONSOLIDATED AND COORDINATED GIFT WRAP DISPLAY

(75) Inventors: Janet Stolle, Hudson, OH (US); Belinda Nemeth, Shaker Heights, OH (US); Dan Kopsak, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 12/127,327

(22) Filed: May 27, 2008

(65) Prior Publication Data

US 2008/0217267 A1 Sep. 11, 2008

Related U.S. Application Data

(63) Continuation of application No. 11/073,107, filed on Mar. 4, 2005, now abandoned.

(51) Int. Cl.
*B42F 17/00* (2006.01)

(52) U.S. Cl. ..... 211/10

(58) Field of Classification Search ..... 211/50, 211/10, 49.1, 60.1, 13.1, 189, 85.5, 85.31, 211/85.28, 85.26; 229/87.19, 923; 40/124, 40/124.2, 124.4

See application file for complete search history.

(56) References Cited

U.S. PATENT DOCUMENTS 1,617,024 A * 2/1927 Munsell et al. ..... 434/98
2,793,760 A * 5/1957 Zel et al. ..... 211/55
3,756,168 A * 9/1973 Bushyhead et al. ..... 108/190
3,908,563 A * 9/1975 Eckart, Jr. ..... 108/77
3,910,412 A * 10/1975 Vargo ..... 206/459.5
D243,907 S * 4/1977 Ferriter et al. ..... D6/461
D265,024 S * 6/1982 Johnson et al. ..... D6/461
4,604,061 A * 8/1986 Willcocks et al. ..... 434/74
D296,283 S * 6/1988 Hardy ..... D6/474
4,925,038 A * 5/1990 Gajewski ..... 211/59.2
D349,202 S * 8/1994 Eliadis et al. ..... D6/467
5,344,027 A * 9/1994 Kaplan ..... 211/1
5,445,272 A * 8/1995 Crisp ..... 206/459.5
5,472,100 A * 12/1995 Garrison et al. ..... 211/45
6,123,197 A * 9/2000 Marquez et al. ..... 206/575
2006/0037873 A1* 2/2006 Elgart ..... 206/223
2006/0196839 A1* 9/2006 Stolle et al. ..... 211/50
2008/0128306 A1* 6/2008 Bateman ..... 206/391

* cited by examiner

*Primary Examiner*—Jennifer E. Novosad
(74) *Attorney, Agent, or Firm*—Roetzel & Andress

(57) ABSTRACT

A consolidated and coordinated gift wrap and packaging display holds and presents articles for decorative gift wrapping in a spectral and thematic arrangement. The consolidated display includes a plurality of modules, each module displaying a plurality of gift wrap items which are coordinated in color, theme or both, so that the modules are visually distinct among the consolidated display. Each module may contain rolled gift wrap, folded gift wrap, small and large gift bags, ribbon on rolls or in stands, gift cards, novelties or gift wrap accessories. The visual distinction of each module within the display draws consumers to the desired type of gift wrap presentation, and the dense arrangement of coordinated and complimentary gift wrap items encourages selection and purchase of a complete gift wrap ensemble.

4 Claims, 7 Drawing Sheets

CONSOLIDATED AND COORDINATED GIFT WRAP DISPLAY

RELATED APPLICATIONS

This application is a continuation of application Ser. No. 11/073,107 filed Mar. 4, 2005 now abandoned.

FIELD OF THE INVENTION

The present invention pertains generally to retail displays and, more particularly, to complex retail displays for displaying multiple kinds and sizes of products in a coordinated fashion.

BACKGROUND OF THE INVENTION

In the retail display of gift wrapping products such as paper, ribbons and bows, it is difficult to present to consumers the wide variety of products available. For gift wrap, some categorization is helpful, yet the physical form of the display should hold the products so that they are readily visible and accessible in order to promote sales. Given the density with which such products can be packaged, it is especially challenging to adequately display a wide variety of colors, textures and themes. This has a large negative effect on total sales and on sell-through of individual gift wrap items, particularly those which are essentially concealed or otherwise obscured on a crowded or poorly arranged display.

Gift wrap accent items, such as bows, ribbons, cards and tissue paper are frequently displayed separate and apart from wrapping paper and gift bags and not coordinated by theme or color. This has a negative effect on the sale of these items, and there has been no successful approach to present to the consumer an assortment of different types of gift wrap products from which a complete and coordinated gift wrap ensemble can be selected for purchase.

SUMMARY OF THE INVENTION

The present invention provides a consolidated and coordinated gift wrap display in which complete groupings of gift wrap products are presented in color coordinated, spectral or thematic arrays. The display as a whole is made up of two or more modules, with each module having common display elements such as relative positioning and arrangement of different types of gift wrap products. Each novel display module contains gift wrap products which are coordinated in some respect, whether by color, theme or other design attribute. The individual modules therefore have common features with respect to the relative positioning of different gift wrap products, so that the display as a whole has uniformity in that regard. And the modules are each unique with respect to at least one design attribute of the coordinated collection of gift wrap products. Each individual module has a novel arrangement of gift wrap products. These and other aspects and features of the invention are further described herein. Adjacent or combined modules of a consolidated display may or may not have the same type and arrangement of gift wrap products.

In accordance with one general aspect of the invention, there is provided a consolidated and coordinated gift wrap display module which has a generally vertically disposed panel having a plurality of fixtures for supporting different types of gift wrap products, including gift wrap sheets, gift bags, bows and ribbons; each of the types of gift wrap products arranged in groups upon the panel, and colors or themes of the gift wrap products being coordinated.

In accordance with another general aspect of the invention, there is provided a gift wrap display which has a plurality of gift wrap display modules, each module having a generally vertically oriented panel with fixtures attached thereto for supporting different types of gift wrap products; the different types of gift wrap products of each module arranged in groups upon the panel and coordinated by color, whereby one type of gift wrap product selected from a module can be used in color coordination with another type of gift wrap product selected from the same module.

In accordance with still another aspect of the invention, there is provided a consolidated and coordinated gift wrap display which is made up of multiple display modules, each display module having a panel with fixtures supporting different types of gift wrap products, each type of gift wrap product being grouped together on the panel, and each of the types of gift wrap products being color coordinated so that gift wrap products of different types can be selected from the same display module and combined to form a color coordinated gift wrap ensemble.

These and other aspects of the invention are herein described in further detail as representative but not exclusive examples of ways in which the broad principles of the invention can be executed and practiced.

DETAILED DESCRIPTION OF PREFERRED AND ALTERNATE EMBODIMENTS

Figure 1:
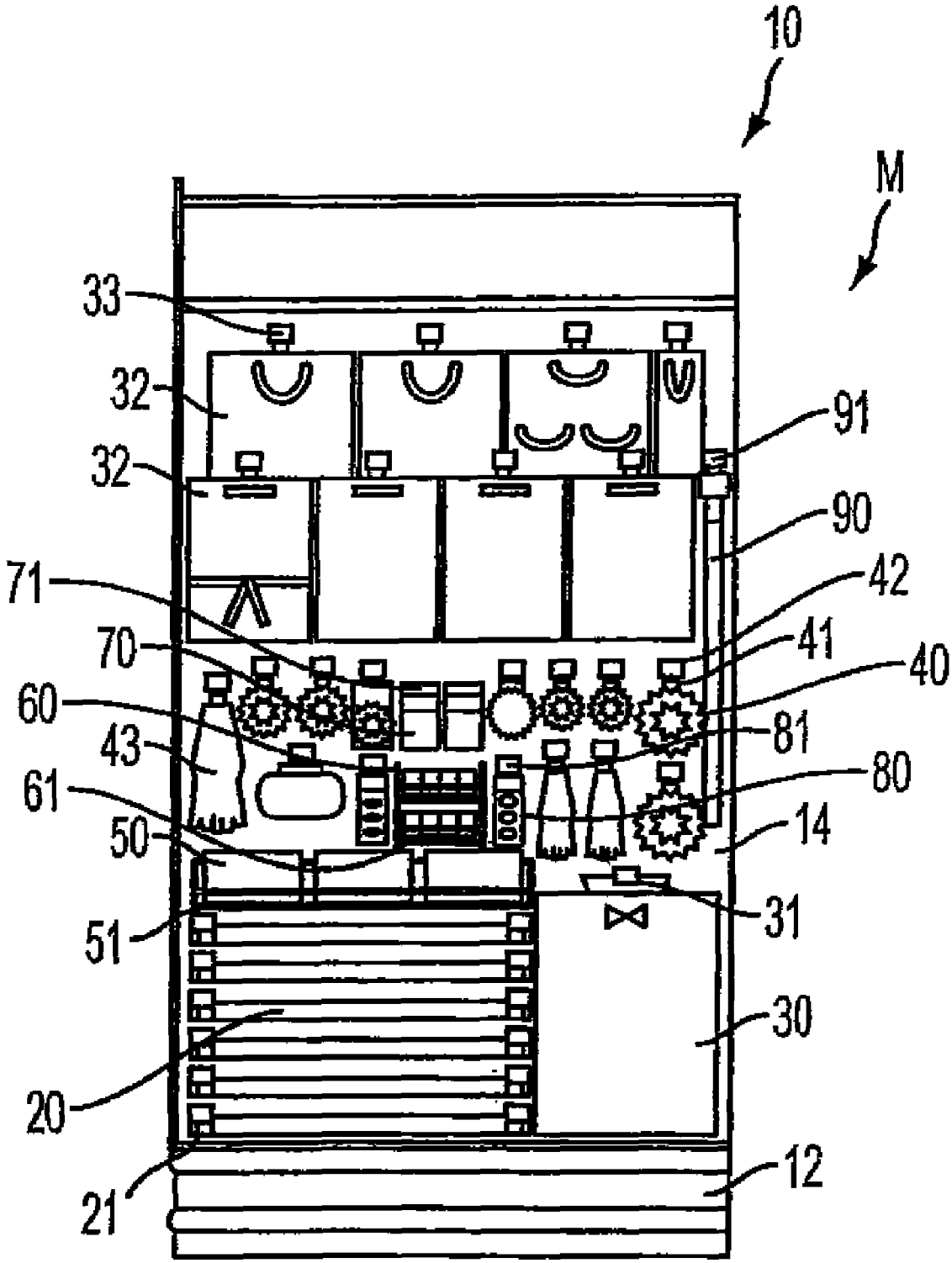
FIGS. 1-4 and 7 are front elevations of various embodiments of the consolidated and coordinated gift wrap product display of the present invention.

A consolidated and coordinated gift wrap display is indicated generally at 10 in each of the FIGS. 1-7. The display 10 can be in the form of what is referred to herein as a module M which is a collection and arrangement of a plurality of gift wrap products within a defined area, such as the rectangular form display shown in FIG. 1. In one representative form, the display module M is made up of a stand or base 12 which provides a foundation for the display for placement on retail floorspace. Rising from the base 12 is a back wall or panel 14 which provides a structure for engagement of product display hardware such as hooks, hangers, racks, shelves, bracketry, all generally referred to as fixtures, and the like as known in the art for gripping, holding or suspending or supporting products in front of or upon panel 14. The panel 14 can be any material suitable for attachment of the various product display fixtures, and can be specifically configured such as slat wall, metal roll form wall with an array of parallel channels, a sheet form wall with openings, or an open lattice of parallel wires or rods.

In this manner, a diverse and dense array of gift wrap products include gift wrap sheets of paper or other material in rolled form, gift bags of various sizes (e.g. relatively small and relatively large), gift wrap sheets of paper or other material which are folded, tissue paper, pre-formed bows (e.g. with adhesive backing and attached to a hang tag), ribbons in strands or on spools (spooled ribbon) on hang tags or in boxes or other packaging, gift cards, novelty items such as trinkets, bobs, charms or other items for attachment to a gift wrapped package, and any other products which are useable as a component of a gift wrap ensemble.

Each of the different types of gift wrap products are generally grouped together upon the module M, such as rolled gift wrap 20, e.g. supported horizontally as shown upon racks 21, relatively large gift bags 30 suspended from a hanger 31 proximate to roll wrap 20; bows 40 on hang-tags 41 suspended from hooks 42, folded gift wrap paper products 50 including wrapping paper and tissue paper upon shelves 51, roll ribbon 60 supported on racks 61, gift cards 70 on hooks 71, gift wrap novelties 80 on hooks 81, ribbon strands 90 on hook 91, and relatively smaller gift bags 32 suspended from hangers 33 in an upper region of the module M.

Figure 2:
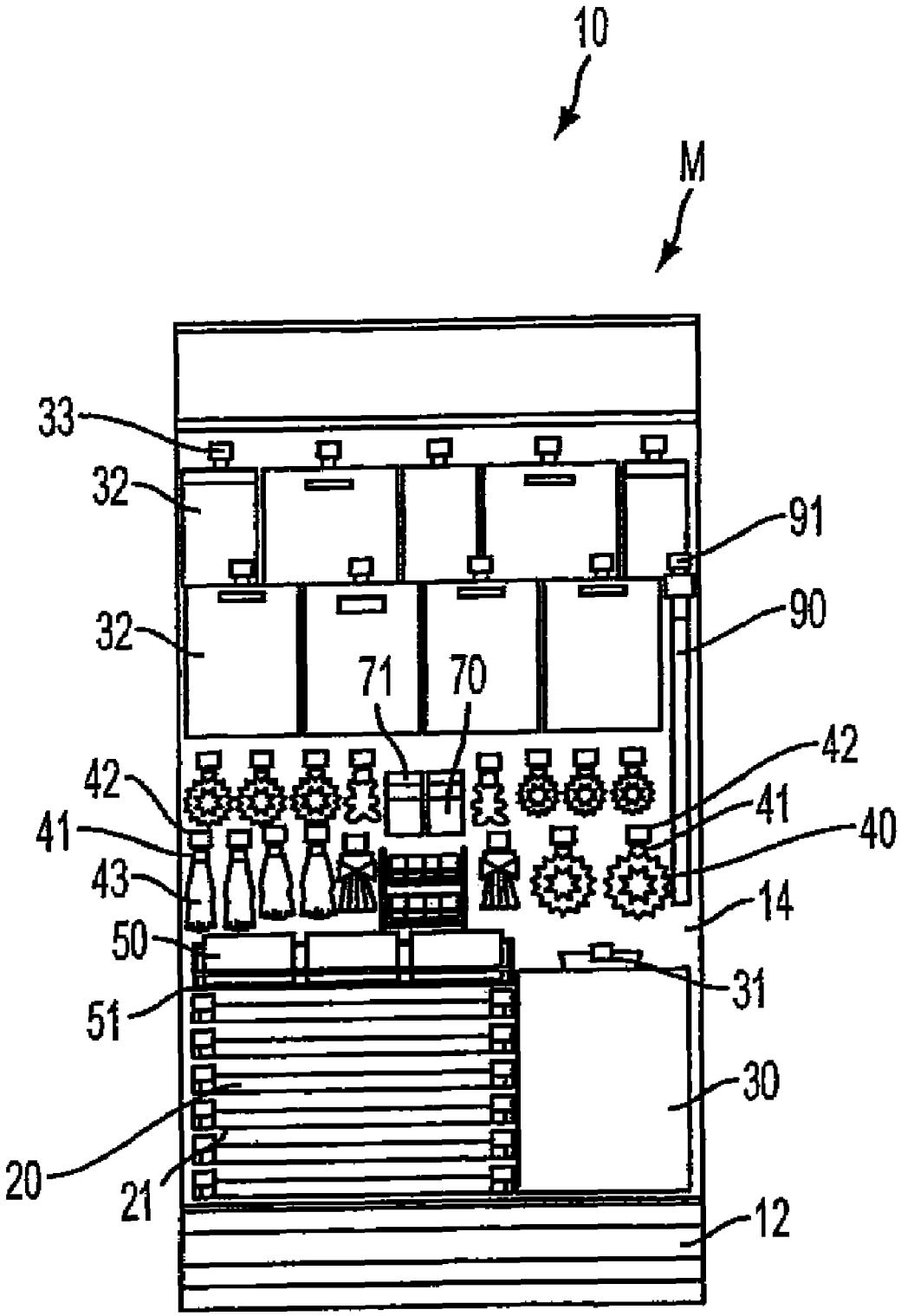
Figure 3:
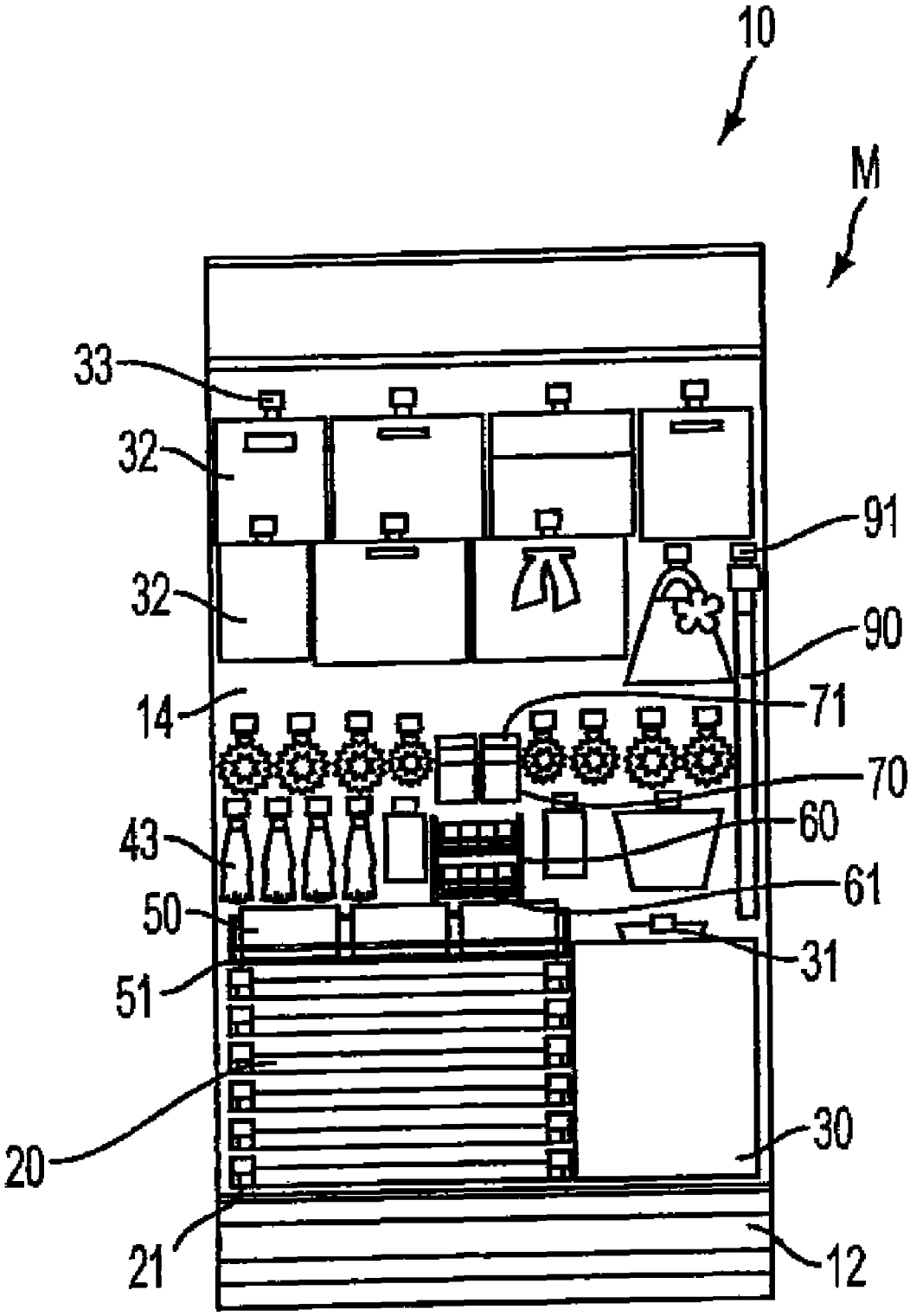
Figure 4:
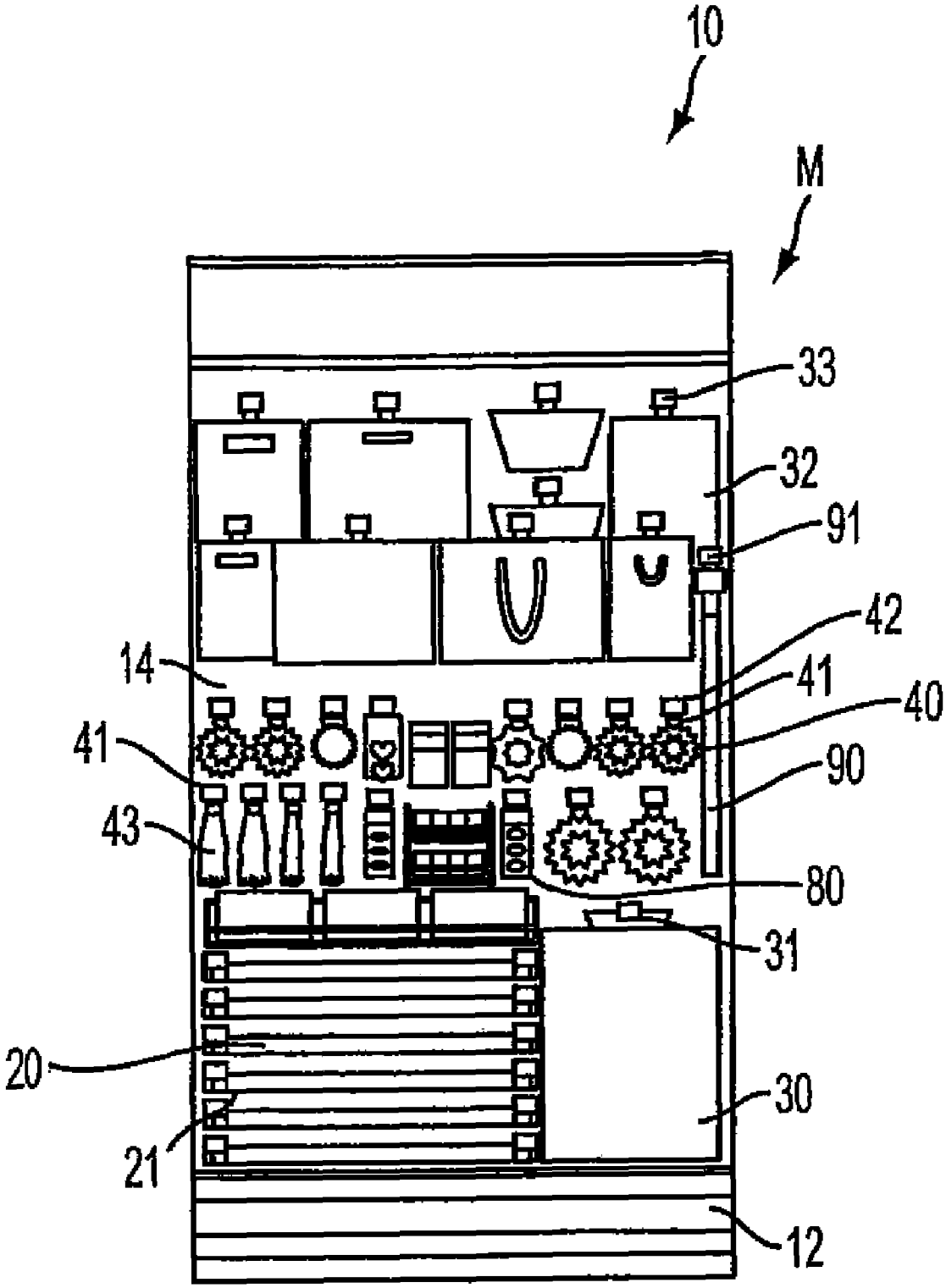

As further shown in FIGS. 2-4, the arrangement of this collection and other collections of gift wrap items on the modules M can be altered according to preferences and to accommodate items of different sizes and shapes. For example, the number and types of bows 40 can vary within the allotted space on the module. This includes star-type bows 40 of different sizes, hanging ribbon-type bows 43 of varying length and width, and any other type of bow displayed also by attachment to a card suspended on hooks.

As is apparent from the foregoing description, the product content of a single module M constitutes a wide array of gift wrap products, i.e., all of the materials and items necessary to create a complete coordinated gift wrap ensemble for a gift or package. As will be further described, multiple modules M, having different collections and arrangements of gift wrapping projects, can be combined in series to form a larger gift wrap display. Each display module M can have a unique theme, defined by color or subject matter or both. For example, a module for feminine gift wrapping may have a plurality of gift wrap items and objects which have complimentary shades of pink or pastel coloring and appropriate designs. The various gift wrap products, paper, ribbon, bows, gift bags, cards, etc. are thus coordinated by color or theme or otherwise to create a gift wrap ensemble. Because the coordinated items are all contained within a module M, they are readily discernable in a combined or consolidated display made of multiple modules, wherein each module has a different gift wrapping color or theme.

Figure 5:
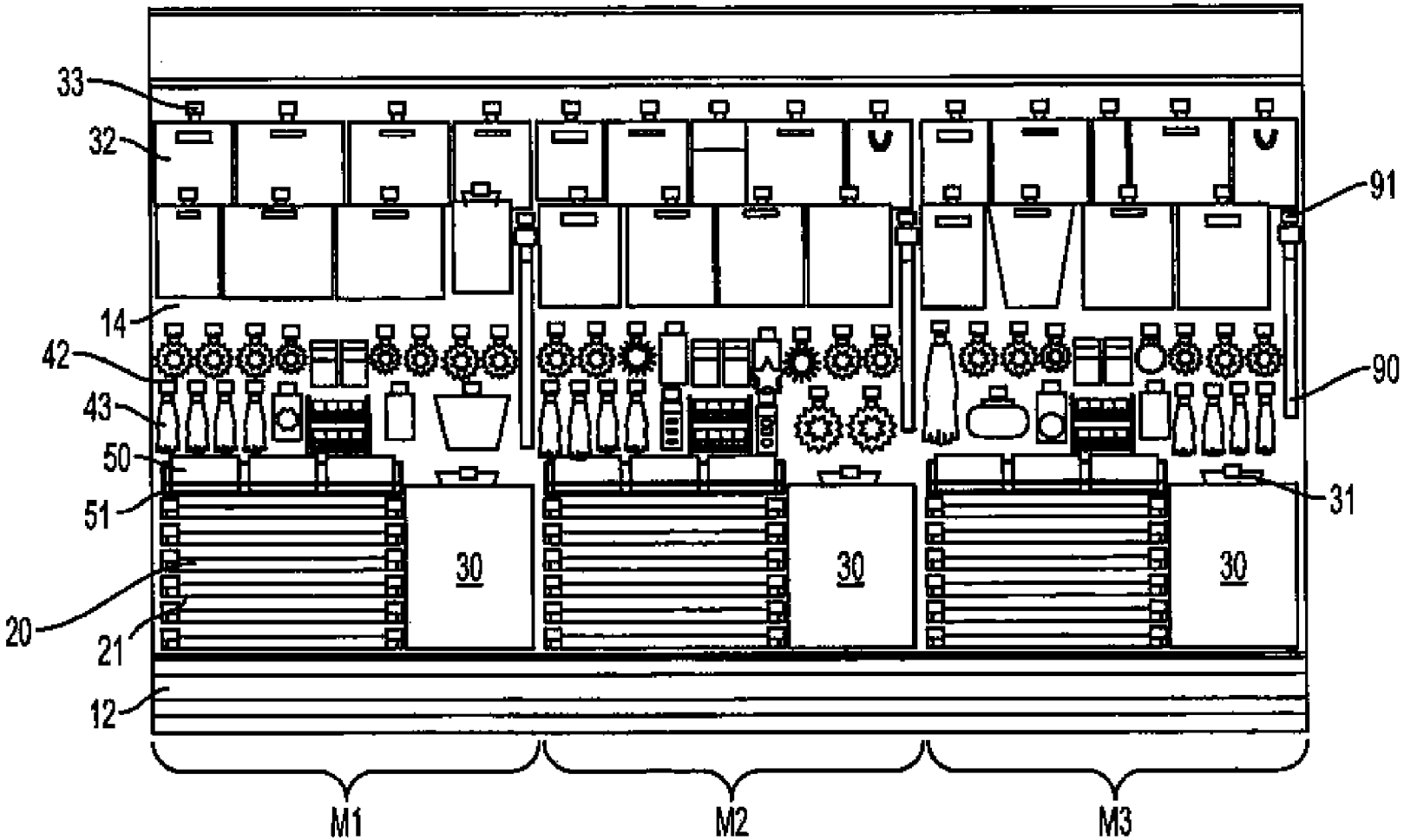
FIGS. 5 and 6 are front elevations of alternated embodiments of consolidated and coordinated gift wrap displays of the present invention.

FIG. 5 illustrates an embodiment of a consolidated and coordinated gift wrap display of the invention, wherein multiple modules M1, M2 and M3 are arranged side-by-side or in series for placement along an aisle of a store. This grouping of multiple modules M forms a consolidated display. As apparent from FIG. 5, the grouped locations of the described gift wrap items in each of the modules M1-M3 is generally the same, with some variation in sizes and shapes of items within some of the groups. For example, all of the various bows on each of the modules are located above the roll wrap 20 and below the smaller gift bags 32, yet within this grouping the collection, type and size of bows may vary among the modules. The same is true with respect to the groupings of smaller gift bags 32, spooled ribbon 60, gift cards 70, and gift wrap novelties 80. The principal distinguishing characteristic of each module M is a color scheme or theme which is unique from the other modules of the display. The modules of the display are thus coordinated, by color or theme or both, or other attributes. In many instances the color scheme is related to the occasion theme of the module, such as for example gift wrap items with shades of silver and white for wedding presents, shades of blue for presents for males, shades of pink for females, bright primary colors for juveniles, pastels for Easter occasion gifts, etc. The coloration of the various gift wrap items of each module need not be all within the same spectrum but more importantly coordinated in some respect. For example, in a module wherein the primary or most visually prominent color is silver, there may be coordinated items which are white, gold, pink or aqua which coordinate well with the silver theme. Although each module may have items of many different colors in this regard, each module nonetheless has a primary color scheme by which it is discernable from the other modules of the display. This, in addition to the compact presentation of a wide assortment of coordinated gift wrap items within each module, greatly facilitates the selection and sale of a complete gift wrap ensemble, resulting in higher sales of gift wrap items.

Figure 6:
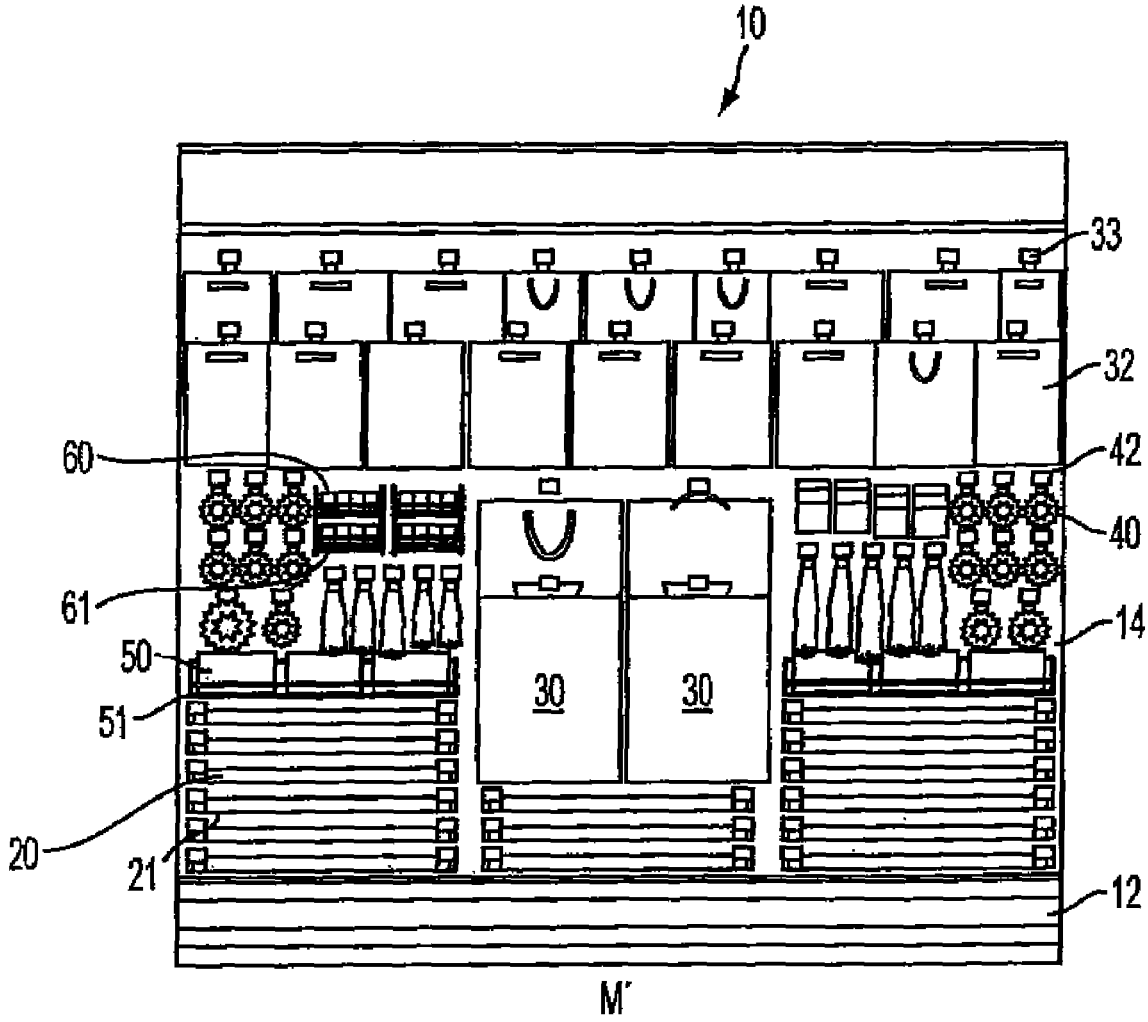

FIG. 5 illustrates three modules M arranged in series, while the invention is of course applicable to less or many more modules arranged in side-by-side series or in any other arrangement for any retail environment. Also, the relative sizes of the modules M may vary in height and width. For example, FIG. 6 illustrates a module M' which has a greater width than modules M1-M3, which accommodates three sections of roll wrap rack displays, with bows displayed above the lateral roll wrap racks, larger gift bags displayed above the central roll wrap racks, and the smaller gift bags displayed in a continuous arrangement across the entire width at the top of the module. Larger module dimensions such as shown in FIG. 6 are able to accommodate larger gift wrap items such as large and oversized gift bags which are centrally displayed, and longer rolls or gift wrap. This expands the versatility of the consolidated display by, for example, having one or more modules devoted to display of items of extraordinary size or shape. This, in addition to color scheme and theme, also serves as a visual distinction of a module in a consolidated display.

Figure 7:
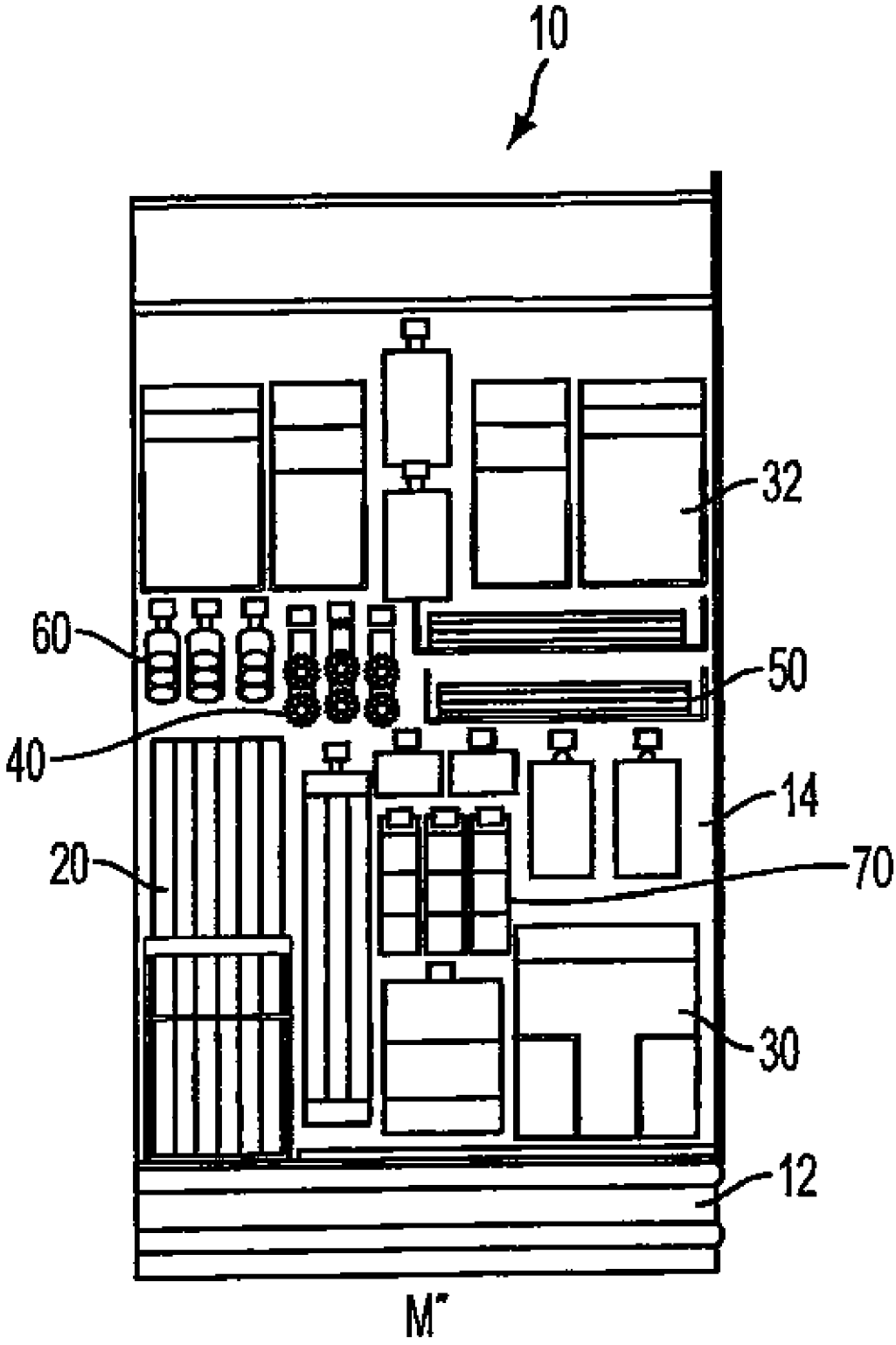

A consolidated display of the invention may further include one or more modules M which have a gift wrap product collection and arrangement which is very different from adjacent or combined modules. For example, FIG. 7 illustrates a module M" which has a different collection and arrangement of gift wrap items, such as roll wrap 20 which is displayed in an upright configuration and in different lengths, large and small gift bags 30, 32 also displayed in an upright configuration, gift cards 70, bows 40, roll ribbon 60 and folded paper products 50 in vertically suspended packages or upon shelves or trays attached to panel 14. The different collection and arrangement of these items within module M" distinguishes it from the other modules of a display, and also serves as a different format for display of gift wrap products of a different classification, such as value priced items, in comparison to those of the rest of the display.

The invention thus provides a consolidated and coordinated gift wrap display made up of multiple modules M, each of which has a distinct visual characteristic defined by coordinated colors, designs and/or themes, and which presents dense groupings of coordinated gift wrap products to the consumer so that a complete gift wrap ensemble can be easily selected. The selection process is facilitated by the color/theme grouping which initially directs a shopper to the appropriate part or module of the consolidated display. Also, the close arrangement of complimentary and coordinated gift wrap items, such as bows being located night next to wrapping paper, and tissue being located night next to gift bags, encourages the selection and purchase of these separate but coordinated items. The display also encourages purchase of extras such as gift cards and accessories which, if not displayed in close proximity, might not occur to the shopper to find and purchase.

What is claimed as the invention is:

1. A coordinated gift wrap display comprising multiple display modules, each display module having a panel with fixtures supporting different types of gift wrap products, each different type of gift wrap product being grouped together in different areas on the panel, whereby a first type of gift wrap product is grouped together in a first area on the panel, and a second type of gift wrap product is grouped together in a second area of the panel; and wherein each of the different types of gift wrap products of a display module have a coordinated color, and wherein the each of the groups of different types of gift wrap products are located in the same relative areas on the panel of each display module;

the different types of gift wrap products of each display module including:

gift wrap sheets; gift wrap rolls; gift bags; bows, and ribbons;

a first display module comprising:

gift wrap sheets having a first coordinated color and arranged in a gift wrap sheet group in a gift wrap sheet area of the panel;

gift wrap rolls in the first coordinated color and arranged in a gift wrap roll group in a gift wrap roll area of the panel;

gift bags in the first coordinated color and arranged in a gift bag group in a gift bag area of the panel;

bows in the first coordinated color and arranged in a bow group in a bow area of the panel, and ribbons in the first coordinated color and arranged in a ribbon group in a ribbon area of the panel;

a second display module comprising:

gift wrap sheets having a second coordinated color and arranged in a gift wrap sheet group in a gift wrap sheet area of the panel;

gift wrap rolls in the second coordinated color and arranged in a gift wrap roll group in a gift wrap roll area of the panel;

gift bags in the second coordinated color and arranged in a gift bag group in a gift bag area of the panel;

bows in the second coordinated color and arranged in a bow group in a bow area of the panel, and ribbons in the second coordinated color and arranged in a ribbon group in a ribbon area of the panel;

and wherein the gift wrap sheet area of the panel of the first display module is in the same relative location as the gift wrap sheet area of the panel of the second display module;

the gift wrap roll area of the panel of the first display module is in the same relative location as the gift wrap roll area of the panel of the second display module;

the gift bag area of the panel of the first display module is in the same relative location as the gift bag area of the panel of the second display module;

the bow area of the panel of the first display module is in the same relative location as the bow area of the panel of the second display module, and the ribbon area of the panel of the first display module is in the same relative location as the ribbon area of the panel of the second display module.

2. The coordinated gift wrap display of claim 1 wherein each of the different types of gift wrap products is coordinated by theme.

3. The coordinated gift wrap display of claim 1 comprising multiple display modules wherein each display module includes different types of gift wrap products which are coordinated in a color unique to each display module.

4. The coordinated gift wrap display of claim 1 wherein each of the different types of gift wrap products of at least one display module are coordinated by a theme which is unique to that display module.

* * * * *